US005819412A

United States Patent [19]

Olden

[11] Patent Number: 5,819,412

[45] Date of Patent: Oct. 13, 1998

[54] JIG SYSTEM FOR THE MANUFACTURE OF COMPOSITE JOISTS AND METHOD OF MANUFACTURING COMPOSITE JOISTS USING JIGS

[75] Inventor: Michael M. Olden, Pacific, Mo.

[73] Assignee: MiTek Holdings, Inc., Wilmington, Del.

[21] Appl. No.: 857,014

[22] Filed: May 15, 1997

[51] Int. Cl.[6] ..... B23P 19/04

[52] U.S. Cl. ..... 29/897.31; 29/786; 100/913; 269/910; 269/47; 269/52

[58] Field of Search ..... 29/281.3, 786, 29/897.31; 100/913; 269/37, 910, 53, 54.4, 54.5, 47, 52; 144/353

[56] References Cited

U.S. PATENT DOCUMENTS

| | | | |
|---|---|---|---|
| 4,379,426 | 4/1983 | Thompson et al. | 100/913 |
| 4,627,564 | 12/1986 | Bowser | 269/910 |
| 5,361,495 | 11/1994 | Pyle et al. | 29/897.31 |

*Primary Examiner*—W. Donald Bray
*Attorney, Agent, or Firm*—Armstrong, Teasdale, Schlafly & Davis

[57] ABSTRACT

A jig system for aligning wooden chords and metal web members in the manufacture of joists, the system includes an assembly surface having a longitudinally extending track therein, and a plurality of jigs positionable in the track. The jigs have upwardly projecting pins for engaging alignment holes in the webs for properly orienting and spacing the webs. The jigs may also have generally parallel alignment bars on either side of the pin for holding the portion of the metal web surrounding the alignment hole therebetween. The jig system can be used in a method of assembling joists which includes the steps of providing web members having a alignment hole at a predetermined height; providing at least one jig having a plurality of pins adapted to engage the alignment holes on the web members; mounting the web members on the jig to vertically align the web members; aligning the top and bottom chords with the aligned web members on the jigs; and pressing the chords and web members together to embed the integral nails on the web members in the top and bottom chords.

14 Claims, 4 Drawing Sheets

JIG SYSTEM FOR THE MANUFACTURE OF COMPOSITE JOISTS AND METHOD OF MANUFACTURING COMPOSITE JOISTS USING JIGS

FIELD OF THE INVENTION

This invention relates to the manufacture of composite joists, and in particular to a jig system for facilitating the manufacture of composite joists.

BACKGROUND OF THE INVENTION

Composite joists made from upper and lower wooden chord members connected by metal web members are widely used in modern construction. The metal web members are typically V-shaped, with integral nails formed at the tops and at the bottom of the "V" such as the POSI-STRUT® web member available from Mitek Industries, Inc., St. Louis, Mo. The POSI-STRUT® web member is shown and described in U.S. Pat. No. 4,348,850, incorporated herein by reference. Composite joists are light weight, use less wood than comparably sized wooden joists, yet are strong and durable and readily accommodate the installation of electrical, plumbing and air handling systems.

The manufacture of composite joists can be time consuming and tedious. Skilled workers are required to ensure that the web members are properly oriented and spaced so that the completed joist has its designed strength and durability. Minor misalignments or small errors in web spacing or orientation can result in a defective joist. However, until the present invention proper joist manufacture depended upon the skill of the workers.

SUMMARY OF THE INVENTION

The present invention relates to a jig assembly for use in the manufacture of joists. The jig assembly helps workers properly align and space the web members to speed the manufacturing process, and improve the accuracy of the placement of the webs. Generally, the jig assembly of the present invention comprises an assembly surface having a longitudinally extending track therein, and a plurality of jigs positionable in the track. The jigs have upwardly projecting pins for engaging alignment holes in the web members for properly orienting and spacing the web members. The jigs allow the web members to be quickly and easily positioned, and hold the web members while the chord members are positioned and joined to the web members to form joists.

The web members preferably have a "V" shape, with an alignment hole located generally in the center of each leg. The jigs preferably include generally parallel alignment bars on either side of each pin for holding the portion of the metal web member surrounding the alignment hole therebetween. The top surfaces of the alignment bars are preferably convexly curved to facilitate fitting the web members therebetween.

In the preferred embodiment there are a plurality of holes longitudinally spaced along the track, and the jigs have elongate slots. A threaded fastener can be inserted through the slots in the jigs and into one of the holes in the track to secure the jig.

Some of the jigs may include arms pivotally mounted about a longitudinal axis to pivot between a horizontal position in which the arms extend transversely from the jig and a vertical position where the arms extend vertically upward from the jigs. When the arms are in their horizontal position they help to space the wooden chord members relative to the web members, but the arms freely pivot upwardly to allow the chords to clear the jig as the joist is lifted off of the jig after the chords have been joined to the webs.

The method of this invention allows for the fast and accurate alignment and spacing of web members to simplify and speed up the manufacture of joists. The method employs web members that have alignment holes at predetermined positions. A plurality of jigs are provided that can be positioned in the track. The jigs have upwardly extending pins that can be engaged by the alignment holes in the web members. The jigs are positioned in the track according to the designed arrangement of web members. Web members are then positioned in the jigs to transversely align, and longitudinally space the web members. Top and bottom chord members can then be aligned with the web members on the jigs, and pressed together to embed the integral nails on the web members in the top and bottom chords.

BRIEF DESCRIPTION OF THE DRAWINGS

Corresponding reference numerals indicate corresponding parts throughout the several views of the drawings.

DETAILED DESCRIPTION OF THE PREFERRED EMBODIMENT

Figure 1:
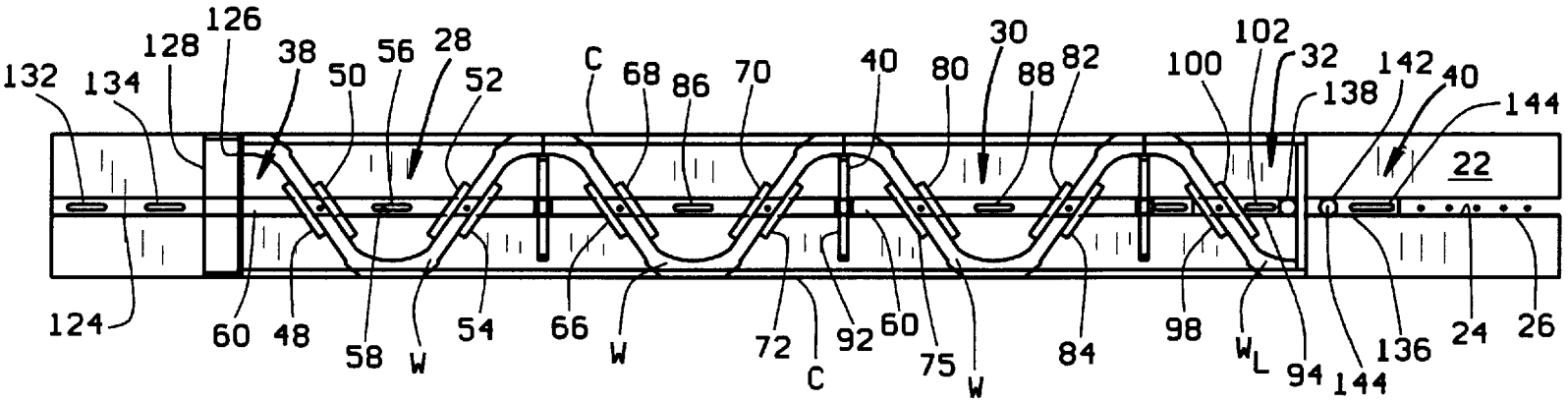
FIG. 1 is a top plan view of a jig system constructed according to the principles of this invention, shown as it would be used to position whole and half web members for joining them with wooden chord members to manufacture composite joists.

A jig system constructed according to the principles of this invention is indicated generally as 20 in FIG. 1. The jig system 20 is particularly adapted for positioning whole and half web members W, and holding the web members in place so that they can be joined with upper and lower wooden chord members C to form composite joists. The web members W are preferably V-shaped, comprising left and right legs and having integrally formed nails for engaging the chord members at the top of each leg, and at the vertex of the "V". It is also common to use just the left half $W_L$ or just the right half $W_R$ of a web member W where a whole web member W would not fit. The jig system 20 comprises an assembly surface 22 having a longitudinally extending track 24 therein. The track 24 is recessed relative to the assembly surface 22. There are preferably a plurality of longitudinally spaced threaded holes 26 in the bottom of the track 24.

Figure 2:
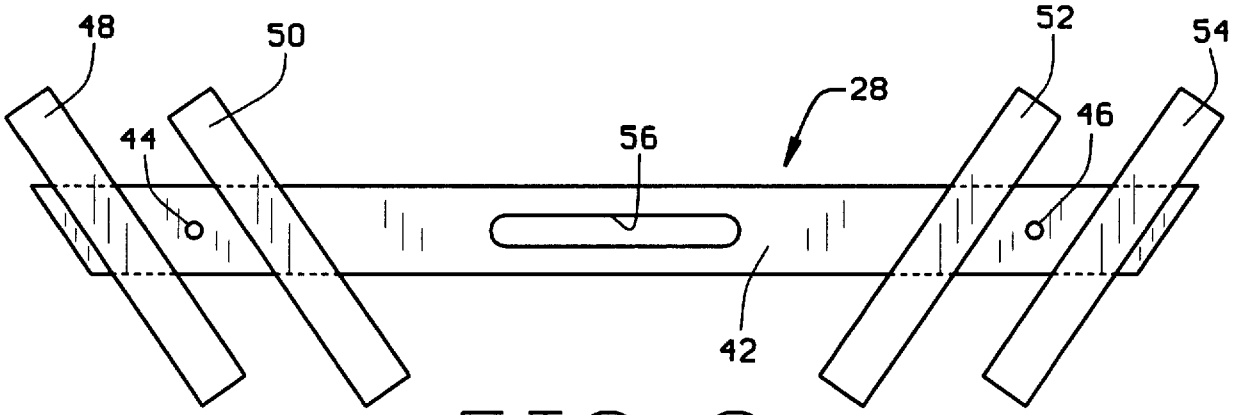
FIG. 2 is a top plan view of a jig for a single web.
Figure 3:
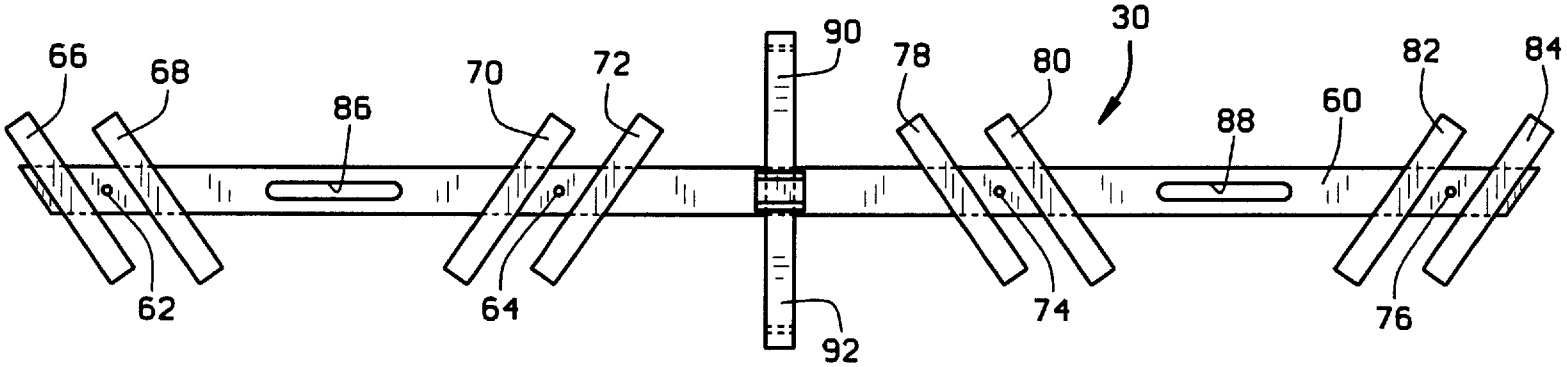
FIG. 3 is a top plan view of a jig for a double web.
Figure 11:
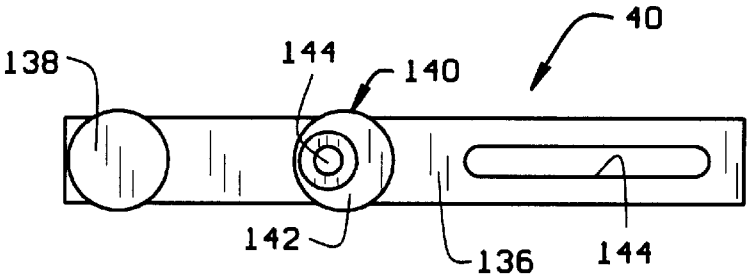
FIG. 11 is a bottom elevation view of the vertical chord holder.

The jig system 20 also includes jigs 28 (FIG. 2) adapted to engage and hold web members W; jigs 30 (FIG. 3)

adapted to hold two web members W; jigs 32 (FIG. 4) adapted to hold the left half of a web member $W_L$; and jigs 34 (FIG. 5) adapted to hold the right half of a web member $W_R$. The jig system 20 also includes chord spacers 36 (FIGS. 6 and 7) for controlling the separation of the upper and lower chords of the composite joist, end stops 38 (FIGS. 8 and 9), and vertical chord holders 40 (FIGS. 10 and 11).

Figure 2A:
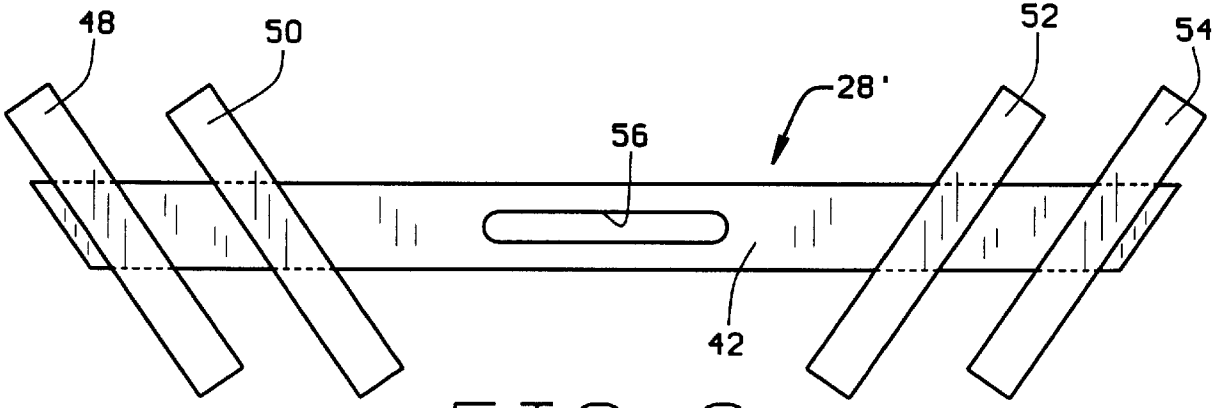
FIG. 2*a* is a top plan view of an alternate construction of a jig for a single web.

As best shown in FIG. 2, the jig 28 comprises a rail 42 adapted to fit in the track 24 with the upper surface of the rail being generally flush with the assembly surface 24. The jig 28 has two pins 44 and 46 projecting upwardly from the upper surface of the rail. The pins are adapted to fit in the alignment holes A in the web members W so that the web member W is held at the correct orientation for mounting chord members that extend generally parallel to the track 24. The jig 24 preferably includes alignment bars 48 and 50 on opposite sides of the pin 44, and alignment bars 52 and 54 on opposite sides of the pin 46. Each pair of alignment bars engage one of the legs of the web member W therebetween, and thus the alignment bars 48 and 50 extend at an oblique angle with respect to the alignment bars 52 and 54. The top surfaces of the alignment bars 48 and 50 and 52 and 54 are convexly curved to guide the legs of the web member W into the space between the alignment bars. The alignment bars may by cylindrical rods welded onto the rail 42. The two pairs of alignment bars 48 and 50 and 52 and 54 facilitate aligning the alignment holes A with the pins 44 and 46. There is also an elongate slot 56 in the rail 42. A fastener 58 can extend through the slot 56 and into one of the holes 26 in the bottom of the track 24 to secure the jig 28 in the track. An alternate construction of jig 28 is indicated generally as 28' in FIG. 2*a*. The jig 28' is similar in construction to jig 28, except that jig 28' does not have the pins 44 and 46. A web member is engaged between the alignment bars 48 and 50 and 52 and 54. Jig 28' is an example, and any of the jigs disclosed herein could be constructed without alignment pins, if desired.

As best shown in FIG. 3, the jig 30 comprises a rail 60 adapted to fit in the track 24 with the upper surface of the rail being generally flush with the assembly surface 22. The jig 30 is similar in construction to jig 28 except that it is adapted to engage two web members W, rather than just one web member. The jig 30 comprises a pair of pins 62 and 64 projecting upwardly from the upper surface of the rail. The jig preferably includes alignment bars 66 and 68 on opposite sides of pin 62, and alignment bars 70 and 72 on opposite sides of the pin 64. Each pair of alignment bars is adapted to engage one of the legs of the web member W therebetween, and thus the alignment bars 66 and 68 extend at an oblique angle with respect to alignment bars 70 and 72. The top surfaces of the alignment bars 66 and 68 and 70 and 72 are convexly curved to guide the legs of the web member W into the space between the alignment bars. The jig 30 also comprises a pair of pins 74 and 76 projecting upwardly from the upper surface of the rail. The jig 30 preferably includes alignment bars 78 and 80 surrounding pin 74, and alignment bars 82 and 84 on opposite sides of the pin 76. Each pair of alignment bars is adapted to engage one of the legs of the web member W therebetween, and thus the alignment bars 78 and 80 extend at an oblique angle to alignment bars 82 and 84. The top surfaces of the alignment bars 78 and 80 and 82 and 84 are convexly curved to guide the legs of the web member W into the space between the alignment bars.

The pins 62 and 64, with the help of their associated alignment bars 66 and 68 and 70 and 72, engage the alignment holes A in one of the web members W, so that the web member W is held at the correct orientation for mounting chord members that extend generally parallel to the track 24. Similarly, the pins 74 and 76, with the help of their associated alignment bars 78 and 80 and 82 and 84, engage the alignment holes A in a second web member W. There are also elongate slots 86 and 88 in the rail 60. Fasteners 58 can extend through the slots 86 and 88 and into one of the holes 26 in the bottom of the track 24 to secure the jig 30 in the track.

The jig 30 also includes arms 90 and 92 pivotally mounted about a longitudinal axis to pivot between a horizontal position in which the arms extend transversely from the rail 60 and a vertical position where the arms extend vertically upward from the rail. The arms 90 and 92, when in their horizontal positions, help to space the wooden chord members relative to the web members. The arms 90 and 92 freely pivot upwardly to allow the chords to clear the jig 30 after they have been joined to the webs. The ends of the arms 90 and 92 have a rounded portion to facilitate the pivoting of the arms as the joist is lifted from the jig.

Figure 4:
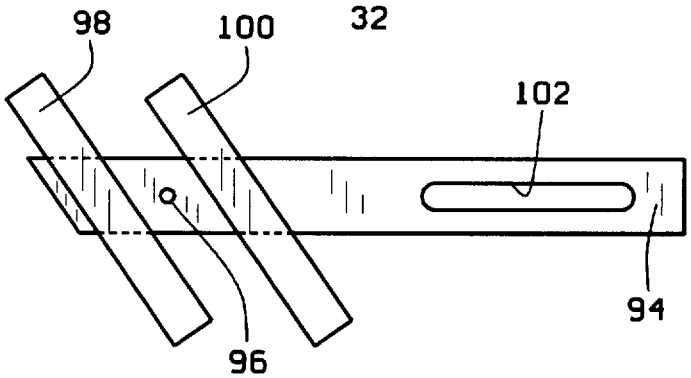
FIG. 4 is a top plan view of a jig for a half web (left half)

As best shown in FIG. 4, the jig 32 comprises a rail 94 adapted to fit in the track 24 with the upper surface of the rail being generally flush with the assembly surface 22. The jig 32 is adapted to engage the left half web member $W_L$. The jig 32 comprises a pin 96 projecting upwardly from the upper surface of the rail. The pin 96 is adapted to fit in the alignment hole A in the left half web member $W_L$ so that the half web member is held at the correct position for mounting chord members that extend generally parallel to the track 24. The jig 32 preferably includes alignment bars 98 and 100 on opposite sides of the pin 64 for engaging the leg of the left half web member $W_L$ therebetween. The top surfaces of the alignment bars 98 and 100 are convexly curved to guide the leg of the left half web member $W_L$ into the space between the alignment bars. There is also an elongate slot 102 in the rail 94. A fastener 58 can extend through the slot 102 and into one of the holes 26 in the bottom of the track to secure the jig 32 in the track.

Figure 5:
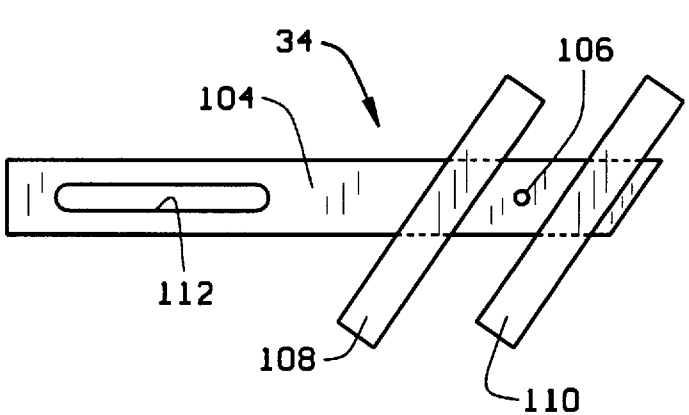
FIG. 5 is a top plan view of a jig for a half web (right half)

As best shown in FIG. 5, the jig 34 comprises a rail 104 adapted to fit in the track 24 with the upper surface of the rail being generally flush with the assembly surface 22. The jig 34 is adapted to engage the right half web member $W_R$. The jig 34 comprises a pin 106 projecting upwardly from the upper surface of the rail. The pin 106 is adapted to fit in the alignment hole A in the right half web member $W_R$ so that the right half web member is held at the correct position for mounting chord members that extend generally parallel to the track 24. The jig 34 preferably includes alignment bars 108 and 110 on opposite sides of the pin 106 for engaging the leg of the right half web member $W_R$ therebetween. The top surfaces of the alignment bars 108 and 110 are convexly curved to guide the leg of the right half web member $W_R$ into the space between the alignment bars. There is also an elongate slot 112 in the rail 104. A fastener 58 can extend through the slot 112 and into one of the holes 26 in the bottom of the track to secure the jig 34 in the track.

Figure 6:
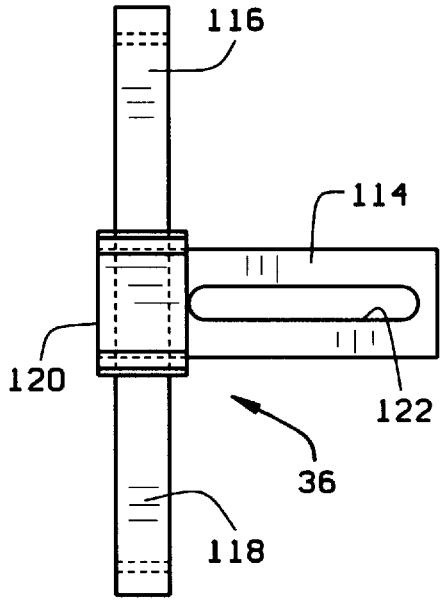
FIG. 6 is a top plan view of a jig for spacing the chord members.
Figure 7:
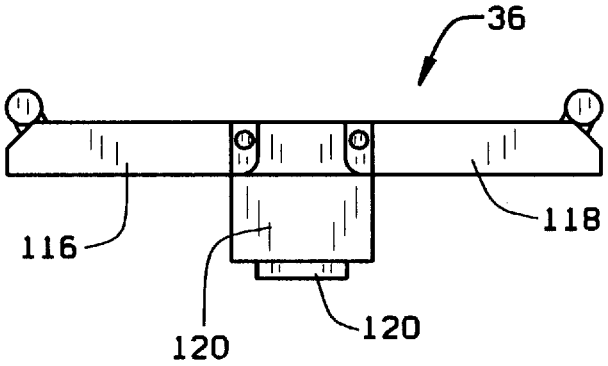
FIG. 7 is a side elevation view of the jig for spacing the chord members.

As best shown in FIGS. 6 and 7, the spacer 36 comprises rail 114 adapted to fit in the track 24 with the upper surface of the rail being generally flush with the assembly surface 22. The spacer 36 comprises arms 116 and 118 pivotally mounted on a block 120 about a longitudinally axis to pivot between a horizontal position in which the arms extend transversely from the rail 114 and a vertical position where the arms extend vertically upward from the rail. The arms 116 and 118, when they are in their horizontal positions, help to space the wooden chord members relative to the web members W. The arms 116 and 118 freely pivot upwardly to allow the chords to clear the spacer 36 after they have been joined to the webs. The ends of the arms 116 and 118 have a rounded portion to facilitate the pivoting of the arms as the joist is lifted from the spacer. There is also an elongate slot 120 in the rail 114. A fastener 58 can extend through the slot 122 and into one of the holes 26 in the bottom of the track to secure the spacer 36 in the track.

Figure 8:
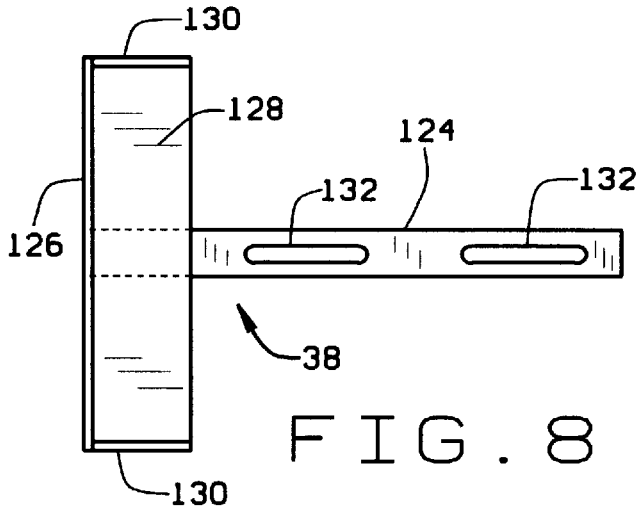
FIG. 8 is a top plan view of an end stop.
Figure 9:
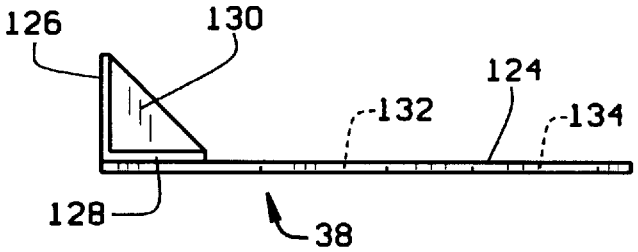
FIG. 9 is a cross-sectional view of the end stop taken along the plane of line 9—9 in FIG. 8.
Figure 10:
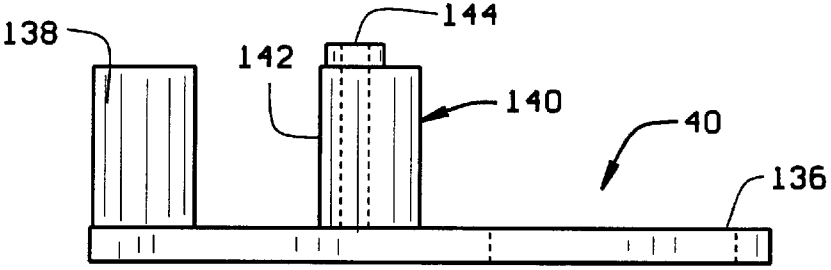
FIG. 10 is a top plan view of a vertical chord holder.

As best shown in FIGS. 8 and 9, the end stop 38 comprises rail 124 adapted to fit in the track 24 with the upper surface of the rail being generally flush with the assembly surface 22. The end stop 38 comprises a vertical wall 126 extending transversely with respect to the rail 124. A horizontal plate 128 extends transversely with respect to the rail 124. Triangular supports 130 extend between the horizontal plate 128 and the vertical wall 126 to support the vertical wall. The wall 126 facilitates aligning the ends of the chord members at the top and bottom of the truss. There are also elongate slots 132 and 134 in the rail 124. Fasteners 58 can extend through the slots 132 and 134 and into one of the holes 26 in the bottom of the track to secure the end stop 38 in the track.

As best shown in FIGS. 10 and 11, the vertical chord support 40 comprises rail 136 adapted to fit in the track 24 with the upper surface of the rail being generally flush with the assembly surface 22. There is a cylindrical boss 138 projecting upwardly from the rail 136. A cam 140, consisting of a cylinder 142, projects upwardly from the rail. The cylinder 142 has a bore therethrough spaced from, but parallel to the axis of the cylinder. A threaded fastener 144 extends through the bore, and into the rail 136. The fastener 144 can be loosened to permit rotation of the cylinder 142, or tightened to secure the cylinder. The cam 140 is positioned relative to the boss 138 such that rotation of the cam can engage a vertical chord member against the boss. There is also an elongate slot 144 in the rail 136. A fastener 58 can extend through the slot 144 and into one of the holes 26 in the bottom of the track 24 to secure the support in the track.

OPERATION

In operation, the jigs 28, 30, 32, and 34 , and the chord spacers 36, the end stops 38, and the vertical chord supports 40 are arranged in the track 24 of the assembly surface 22, according to the joist design. For example, as shown in FIG. 1, an end stop 40 is placed in the left end of the track 24, and secured with a fastener 58 extending through the slots 132 and 134 and into the holes 26 in the bottom of the track 24. The end stop 40 helps align the ends of the chords as the chords are placed on the webs. A single web jig 28 is placed adjacent the end stop 40, and secured with a fastener 58 extending through the slot 56 and into one of the holes 26 in the track 24. A chord spacer 36 is placed in the track next to the single web jig 28, and secured with a fastener 58 extending through the slot 122 and into one of the holes 26 in the track 24. A double web jig 30 is placed in the track 24 next to the spacer 36, and is secured with fasteners 58 extending through the slots 86 and 88 and into holes 26 in the bottom of the track 24. Another chord spacer 36 is placed next to the jig 30, and secured with a fastener 58 extending through the slot 122 and into a hole 26 in the bottom of the track 24. A left half web jig 32 is placed in the track 24, next to the chord spacer 36, and secured with a fastener 58 extending through slot 102 and into a hole 26 int the bottom of the track 24. Finally, a vertical chord support 40 is placed next to the jig 32, and secured with a fastener 58 extending through the slot 146 and into one of the holes 26 in the bottom of the track 24. The jig system is now prepared for the placement of the webs members.

A first web member W is placed in the jig 28. The alignment bars 48 and 50 and 52 and 54 help position the web member so that its alignment holes A align with the pins 44 and 46. When the web W is properly positioned, it drops into the jig, and the pins 44 and 46 extend upwardly through the alignment holes A. Alternatively, when a jig 28' is used, the alignment bars 48 and 50 and 52 and 54 provide the orientation and positioning of the web member. Two more web members W are then placed in the jig 30. The alignment bars 66 and 68 and 70 and 72 help position one of the web members W so that its alignment holes A align with pins 62 and 64. Similarly, the alignment bars 78 and 87 and 82 and 84 help position the other of the web members W so that its alignment holes A align with pins 74 and 76. When the webs are properly positioned, they drop down into the jig 30, with the pins 62 and 64 extending upwardly through the alignment holes A in one of the web members, and the pins 74 and 76 extending upwardly through the alignment holes A in the other of the web members. Finally, a left half web member WL is placed in the jig 32. The alignment bars 98 and 100 help position the web member WL so that its alignment hole A aligns with the pin 96. When the web member WL is properly positioned, it drops into the jig 32.

A vertical cord member can be secured in the vertical chord holder 40. The chord is placed between the cylindrical boss 138 and the cam 140. The cylinder 142 of the cam 140 is rotated until it engages the vertical chord member against the boss 138, and is secured with the fastener 144. The arms 90 and 92 of the jig 30, and the arms 116 and 118 of each of the two spacers 36 are extended to the horizontal positions. Upper and lower chord members are then placed on the web members held in the jigs. The left ends of the chord members are butted against the end wall 126, the bottom of the upper chord member is pressed against the ends of the arms 90 and 116. The top of the lower chord member is pressed against the ends of the arms 92 and 118. When the chord members are properly positioned, they can be joined to the web members by pressing the wooden chord members against the integrally formed nails in the web members. This can be done with a press or a roller. The jigs system can be used to set up the web members for the other side of the joist, or these can be placed manually on the half completed joist.

It is claimed:

1. A jig system for aligning wooden chords and metal web members in the manufacture of joists, the system comprising an assembly surface having a longitudinally extending track therein, and a plurality of jigs positionable in the track, the jigs having upwardly projecting pins for engaging alignment holes in the web members for properly orienting and spacing the web members.

2. The jig system according to claim 1 wherein the jigs further comprise generally parallel alignment bars on either side of the pin for holding the portion of the metal web member surrounding the alignment hole therebetween.

3. The jig system according to claim 2 wherein the top surfaces of the alignment bars are convexly curved to facilitate fitting the web members therebetween.

4. A jig system for aligning wooden chords and metal web members in the manufacture of joists, the system comprising an assembly surface having a longitudinally extending track therein, and a plurality of jigs positionable in the track, the jigs having parallel alignment bars therein for engaging portions of the web members between them for properly orienting and spacing the web members.

5. The jig system according to claim 4 wherein the top surfaces of the alignment bars are convexly curved to facilitate fitting the web members therebetween.

6. A jig system for properly positioning V-shaped web members and wooden cord members in the manufacture of joists, the V-shaped web members having alignment holes in their legs, the system comprising an assembly surface having a track therein, and a plurality of jigs positionable in the track, the jigs having upwardly projecting pins for engaging the alignment holes in the webs, the jigs aligning the web members in the transverse direction and properly spacing the web members in the longitudinal direction.

7. A jig system for properly positioning V-shaped web members and wooden cord members in the manufacture of joists, the V-shaped web members having an alignment hole in each leg, the system comprising an assembly surface having a track therein, and a plurality of jigs positionable in the track, each jig having two upwardly projecting pins for engaging the alignment holes in the web to properly orient the web in the transverse direction and to properly space the webs in the longitudinal direction.

8. The jig system according to claim 7 further comprising arms pivotally mounted about a longitudinal axis to pivot between a horizontal position in which the arms extend transversely from the jig and a vertical position where the arms extend vertically upward from the jigs, the arms when in their horizontal positions helping to space the wooden chord members relative to the web members, the arms freely pivoting upwardly to allow the chords to clear the jig after they have been joined to the webs.

9. The jig system according to claim 7 further comprising generally parallel alignment bars on either side of the pin for holding the portion of the metal web surrounding the alignment hole therebetween.

10. The jig system according to claim 9 wherein the top surfaces of the alignment bars are convexly curved to facilitate fitting the web members therebetween.

11. The jig system according to claim 9 wherein there are a plurality of spaced holes in the track, and wherein there is an elongate slot in the jig through which a fastener can extend into one of the holes in the track.

12. The jig system according to claim 9 wherein the ends of the jigs are angled to interfit in a particular orientation.

13. A method of assembling joists of the type comprising wooden top and bottom chords joined by metal web members engaging the chords with a plurality of integrally formed nails, the method comprising:

providing an assembly surface having a longitudinally extending track therein;

providing web members having alignment holes at a predetermined height;

providing a plurality of jigs positionable in the track, and having pins which when the jig is positioned in the track project upwardly;

positioning the jigs in the track;

placing the web members on the jig members with the alignment holes in the webs receiving upwardly projecting pins in the jigs to transversely align and longitudinally space the web members;

aligning the top and bottom chords with the aligned web members on the jigs;

pressing the chords and web members together to embed the integral nails on the web members in the top and bottom chords.

14. A method of assembling joists of the type comprising wooden top and bottom chords joined by metal web members engaging the chords with a plurality of integrally formed nails, the method comprising:

providing web members having alignment hole at a predetermined height;

providing at least one jig having a plurality of pins adapted to engage the alignment holes in the web members;

mounting the web members on the jig to vertically align the web members;

aligning the top and bottom chords with the aligned web members on the jigs; and pressing the chords and web members together to embed the integral nails on the web members in the top and bottom chords.

* * * * *